US012612752B2

(12) United States Patent
Roach

(10) Patent No.: US 12,612,752 B2
(45) Date of Patent: Apr. 28, 2026

(54) SYSTEM FOR REMOTELY OPERATED SUBSURFACE MEASUREMENTS

(71) Applicant: FNV IP B.V., Leidschendam (NL)

(72) Inventor: Paul Roach, Leidschendam (NL)

(73) Assignee: FNV IP B.V., Leidschendam (NL)

( * ) Notice: Subject to any disclaimer, the term of this patent is extended or adjusted under 35 U.S.C. 154(b) by 383 days.

(21) Appl. No.: 18/273,924

(22) PCT Filed: Jan. 28, 2022

(86) PCT No.: PCT/EP2022/052120

§ 371 (c)(1),
(2) Date: Jul. 24, 2023

(87) PCT Pub. No.: WO2022/167344

PCT Pub. Date: Aug. 11, 2022

(65) Prior Publication Data

US 2024/0076847 A1 Mar. 7, 2024

(30) Foreign Application Priority Data

Feb. 2, 2021 (NL) ..... 2027477

(51) Int. Cl.
*E02D 1/02* (2006.01)
*E02F 9/20* (2006.01)

(52) U.S. Cl.
CPC ..... *E02D 1/022* (2013.01); *E02F 9/205* (2013.01)

(58) Field of Classification Search
CPC ..... E02D 1/022; H04W 28/0252; H04W 28/0268; H04W 40/22; H04W 40/246;
(Continued)

(56) References Cited

U.S. PATENT DOCUMENTS 4,441,561 A 4/1984 Garmong et al.
2009/0297273 A1* 12/2009 Lindbergh ..... G01P 3/22 702/9

(Continued)

FOREIGN PATENT DOCUMENTS

RU 2601350 C1 11/2016
RU 2601637 C1 11/2016
WO 2018132861 A1 7/2018

OTHER PUBLICATIONS

International Search Report and Written Opinion for PCT application No. PCT/EP2022/052120, mailed on Sep. 3, 2022, 12 pages.

(Continued)

*Primary Examiner* — Chun Cao
(74) *Attorney, Agent, or Firm* — Polsinelli PC

(57) ABSTRACT

A system is provided, including
- a remotely operated machine having:
  - a coiled rod with a probe to be penetrated into subsurface by uncoiling the rod;
  - a tracking unit determining a position of the machine; and
  - adjustable support legs for stabilizing and levelling the machine;
- a remote workstation having a user interface for data input and output;
  - a tracking control unit for tracking movement of the machine based on its position;
  - a levelling control unit for controlling the support legs; and
  - a deployment control unit for controlling uncoiling of the rod and penetration of the probe into the subsurface;
- the tracking control unit, levelling control unit and deployment control unit configured to communicate (Continued)

with the remote workstation allowing operation of these units to be monitored, initiated and/or controlled via the user interface; and the tracking control unit, levelling control unit, and deployment control unit configured to transmit a signal indicating successful execution of its operation.

20 Claims, 5 Drawing Sheets

(58) Field of Classification Search
CPC ... H04W 40/248; H04W 76/11; H04W 76/14; H04W 8/14; H04W 8/22; H04W 8/26; H04W 88/04; H04W 88/085; H04W 92/04; E21B 15/003; E21B 15/04; E21B 17/20; E21B 19/08; E21B 19/22; E21B 7/02
USPC ..... 700/65
See application file for complete search history.

(56) References Cited

U.S. PATENT DOCUMENTS

| | | | | |
|---|---|---|---|---|
| 2017/0145750 | A1* | 5/2017 | Looijen | E02D 1/022 |
| 2020/0240268 | A1* | 7/2020 | Li | E21D 9/003 |
| 2022/0381007 | A1* | 12/2022 | Hodel | E02F 3/437 |

OTHER PUBLICATIONS

English language equivalent of Russian patent application No. RU 2601637, retrieved on Jul. 24, 2023, 5 pages.
English language equivalent of Russian patent publication No. RU 2601350 retrieved on Jul. 24, 2023, 8 pages.
Exam Report for Brazillian Application No. BR102021013124-1, dated Feb. 4, 2026, 4 pages.

* cited by examiner

SYSTEM FOR REMOTELY OPERATED SUBSURFACE MEASUREMENTS

CROSS-REFERENCE TO RELATED APPLICATIONS

This application is a national stage application of International Application No. PCT/EP2022/052120, which was filed on Jan. 28, 2022, which claims priority to Netherlands Application Number 2027477 filed on Feb. 2, 2021, both of which are incorporated by reference in their entireties.

FIELD OF THE INVENTION

The present invention relates to a system comprising a remotely operated machine. The machine is configured for autonomous or semi-autonomous operation, with the operator of the machine located remote from the machine. In particular, the system relates to a cone penetration testing, CPT, system, wherein the machine carrying the CPT probe is operated fully from a remote workstation. In another aspect, the system relates to a system for inserting and installing subsurface sensors at a plurality of measurement locations of a site for remote monitoring of the site. The present invention further relates to a computer program controlling the operation of the remotely operated machine.

BACKGROUND ART

Cone penetration testing is a well-known technology for collecting subsurface measurement data by penetrating various types of sensors into the ground. Thereby, information about the geological situation at the location of testing can be retrieved, allowing risk assessment and design decisions relating to structures, such as tunnels, bridges, earthworks, foundations, etc.

At present, when performing cone penetration testing, the operator of the CPT machine is located in a cabin on the back of a lorry or a tracked machine carrying the CPT probe, in close proximity to high pressure hydraulic equipment pushing the probe into the ground. Conventionally, the operators are required to screw sections of rods together as a set of hydraulic cylinders go up and down gripping the rods pushing them into the ground at a force required to achieve a desired penetration rate, the force depending on the resistance of the geology below ground. The operators further have to handle a wire carrying the data that is fed from the sensors through the rods, operate the hydraulic lever and screw the rod sections together. This physically hard work often lead to early retirement due to e.g. repetitive strain injuries or other physical complaints. This is not sustainable and a solution is desired.

Solutions overcoming drawbacks associated with having to manually assemble separate rod sections are presented by US 2017/0145750 A1 and EP 3 306 032 B1. According to the systems presented herein, the rod, to which the CPT probe is connected, is stored in a coiled manner, and uncoiled during penetration of the ground with the probe.

While these systems greatly improve the situation of the operator and facilitate more efficient sampling of CPT data, certain tasks still require manual work of the operator at the machine. In certain situations, e.g. where the geological stability of the location or site and/or of structures in the vicinity is unknown, this is undesirable as it may lead to dangerous situations for the operators.

Further, it may be desirable to monitor, over time, geotechnical structures which are at risk of failure, in order to timely detect increased risk or imminent failure of a structure, without exposing human operators to potential risks. Examples of such sites or locations typically includes bridges. dams, geological formations, and areas downstream for example a tailing dam.

SUMMARY OF THE INVENTION

It is an object of the invention to address one or more of the problems and drawbacks identified herein above.

In particular, it is an object of the invention to provide a system enabling a machine, for example a CPT machine or other machine or apparatus enabling monitoring geological or subsurface conditions, to be fully and reliably remotely operated.

In another embodiment, an object of the invention is to provide a computer program causing, when run on a computer, one or more steps of operation of the machine to be performed.

Embodiments of the invention are claimed in dependent claims.

In a first aspect a system is provided, the system comprising:

- a remotely operated machine comprising a mobile platform, the mobile platform carrying:
  - a rod, configured to be stored in a coiled state on said mobile platform;
  - a probe comprising one or more sensors, the probe mounted to a first end of said coiled rod and configured to be penetrated into the subsurface by uncoiling said rod;
  - a tracking unit configured to determine a position of said mobile platform; and
  - a plurality of adjustable support legs for stabilizing and/or levelling said mobile platform;
- a remote workstation configured to be located remote from said machine, said remote workstation comprising a user interface for outputting data to an operator and receiving input data from the operator;
- a tracking control unit configured to track and control movement of said mobile platform using position data from said tracking unit;
- a levelling control unit, configured to control deployment and adjustment of said support legs; and
- a deployment control unit, configured to control penetration of said probe into the sub surface;
- wherein the tracking control unit, the levelling control unit, and the deployment control unit are configured to communicate with said user interface of said remote workstation such that operation of each of these units can be monitored, initiated and/or controlled via said user interface; and
- wherein each of said tracking control unit, said levelling control unit, and said deployment control unit is configured to transmit a signal indicating that its associated operation has been executed in accordance with specification.

This system enables remotely controlled, (semi-) autonomous subsurface measurements, such as CPT measurements, and/or subsurface installation of sensors for remote monitoring of a site. The system relies on remotely operated and automated components that require no physical input from a human at the point of execution of the operation, i.e., at the machine. This enables truly and reliable remote operation where at no point in the automation flow a human needs to be present at the machine.

The system is configured and/or programmed to perform a plurality of successive operations, also referred to as a chain of events, in order to perform subsurface measurements and/or installation sensors into the subsurface, wherein each of the operations is performed only if a preceding operation has been executed or performed successfully, i.e., in accordance with specifications. Each successive operation may be either automatically initiated by a signal transmitted upon the preceding operation having executed successfully, or upon an operator initiating the operation upon having observed the signal. Thereby, a (semi-) autonomous operation is realized.

The tracking control unit, the levelling control unit, and the deployment control unit may each comprise, or be realized by, a programmable logic controller, PLCs, configured for electronic control of the different components of the system. The tracking control unit, the levelling control unit, and the deployment control unit may be considered to form part of a processing system or processing unit controlling the system including the remotely operated machine.

The plurality of successive operations, or events, may hence be controlled by programmable logic controllers, PLCs. The PLCs may be programmed such that a positive signal is sent by a predecessor in the chain of events to confirm that the associated event has been successful, with no undesired outcomes or errors, such that the successor to the event can continue, i.e., the chain of events can proceed. Thereby a "fail to safe" system can be realized, since if an event in the chain does not occur as expected then subsequent events do not continue and an alert is sent, e.g. to a supervising operator, in order that human interaction can make it safe again.

The probe may alternatively be referred to as, or substituted by, a sensor holder or adapter, in which the sensors may be arranged in a fixed manner or such as to be released from the sensor holder.

The levelling control unit may be configured to initiate deployment and adjustment of the support legs in response to receiving the signal from the tracking control unit that the mobile platform has been positioned at a predetermined location.

The deployment control unit may be configured to initiate penetration of said probe into the subsurface in response to receiving the signal from the levelling control unit that the mobile platform has been stabilized and levelled. The deployment control unit is generally further configured to control retraction of said rod.

The user interface may be configured to receive a signal from an operator for triggering operation of any one of the tracking control unit, the levelling control unit, and the deployment control unit.

The remote workstation may be configured to enable monitoring and communicating with a plurality of remotely operated machines.

Advantageously, the deployment control unit is configured to receive measurement data from the one or more sensors and to control penetration of the probe into the subsurface based on the measurement data. The deployment control unit may be further configured to detect and/or predict potential failure to the equipment due to a potential subsurface obstruction located further subsurface but immediately below the probe based on the measurement data and to stop penetration of the probe prior to the subsurface obstruction causing failure of any part of the subsurface components, thereby avoiding resulting damage of the system and allowing the system to continue automated reducing downtime and improving efficiency over the traditional method. By using such computerized methods, which in embodiments may be performed using algorithms involving artificial intelligence, obstacle prediction may be performed with higher accuracy and reliability than when this is performed based on knowledge and experience of the human operators of the machine, as is done in conventional systems. Thereby, damage to the system and the geotechnical apparatus, in particular the coiled rod and the drive system thereof, can be avoided, while at the same time avoiding stopping penetration unnecessarily far from the subsurface obstruction. This increases data capture volume and quality, uncertainty of the sub-surface and therefore design risk is decreased, and the final design of the permanent structure is more efficient during the build process and safer for end users/clients.

The deployment control unit may be configured to control said penetration of said probe based on a position of said mobile platform received from said tracking unit and/or stratigraphic data related to said position. Thereby, known properties and characteristics of the site may be taken into account during measurement and/or sensor installation.

Advantageously, the mobile platform may comprise a data transmission unit for transmitting measurement data acquired by said one or more sensors substantially real-time to the remote workstation. The remote workstation is subsequently able to allow remote viewing during data acquisition or immediately following completion of a CPT, allowing operational or scope based decision making from a contractor, designer or client office.

The tracking control unit may be configured to control movement of the mobile platform to a predetermined first location and to control movement of the mobile platform to a predetermined second location after operations controlled by the deployment control unit have been executed at the first location.

The mobile platform may be provided with one or more cameras configured to communicate with the remote workstation for transmitting image data thereto; and the tracking control unit may comprise an obstacle detection system; wherein the user interface is configured to output said image data and data from said obstacle detection system and to receive input data from an operator for controlling movement of the machine.

The tracking control unit may be configured to determine a path of movement of the mobile platform based on a position of the platform recorded by the tracking system and on topographical data. According to embodiments, the tracking control unit is configured to automatically determine the path of movement.

The user interface is advantageously configured to display prerecorded or otherwise known topographical data overlaid on satellite navigation data map. The tracking control unit may be configured to control movement of the machine along a path of movement determined based on input from an operator. Thereby, the path of movement of the machine may be determined such as to avoid different types of obstacles between measurement locations, and/or a most efficient path may be determined.

The tracking control unit may be configured to control a velocity of movement of the mobile platform based on input from the operator via the user interface of the remote workstation.

According to some embodiments, each of the tracking control unit, the levelling control unit, and the deployment control unit is configured to transmit a second signal comprising one or more pre-defined parameters related to an outcome and/or result of its operation, and the processing system configured to process the second signal and/or forward the second signal to another one of the tracking control unit, the levelling control unit, and the deployment control unit. Thereby, additional information relating to the system and its operation can be provided to the different control units or processors, allowing these to be taken into account during the different steps of operation.

In embodiments, the mobile platform comprises a coil support device for supporting the rod in the coiled state and allowing the rod to transition between the coiled state and an uncoiled state, wherein the coil support device can be positioned in a folded mode or in an unfolded mode. The deployment control unit may be configured to move the coil support device from the folded mode to the unfolded mode prior to penetration of the probe into subsurface. The coiled rod may be arranged in the folded mode during transportation of the machine, in order to prevent damage thereto, and during movement of the machine between different measurement locations.

According to a second aspect, the machine of the first aspect is a machine for cone penetration testing, CPT, wherein the probe is a CPT probe provided with said one or more sensors. The deployment control system may be configured to penetrate the probe at a substantially constant rate, and the processing unit may be configured to display a graphical plot on the user interface based on measurement data recorded by the one or more sensors. Thereby, the operator can get a real time view of the geological properties at the measurement site.

According to a third aspect, the machine of the first aspect is a machine for installing sensors at subsurface locations, such as for remote monitoring of a site, and the probe may be configured to be disconnected from the first end of the rod prior to retraction of the rod. The probe may further comprise a sensor cable, the one or more sensors connected to the sensor cable. Alternatively, an adaptor or sensor holder, in which the sensors and the sensor cable are arranged such as to be disconnected therefrom may be used instead of a probe. The probe or sensor may be disconnected due to friction between the probe or sensor and the surrounding as the rod is retracted from the sub surface.

Thereby, sensors can be remotely installed enabling continuous monitoring of a site, in particular a site to which human access is highly undesirable due to the potential risk of imminent failure of a structure at or on the site, for example a tailing dam or hazardous earthworks structure. Depending on the type of sensors and other equipment for performing monitoring, after installation of the sensors the site may be continuously monitored for an extended period of time, up to several years.

In particular, pressure sensors or transducers may be installed using the machine of the third aspect. However, alternatively or additionally, gas sensors and/or temperature sensors may also be installed using the machine.

The machine for installing sensors may further comprise a pumping unit for filling a void between the one or more sensors, or the probe, and surrounding ground with a fixation material. The filling of the void, or annulus, may be performed while the rod is being retracted from the subsurface. Typically, bentonite may be used as the filling substance, or fixation material, although other materials or substances may alternatively be used.

In embodiments, the system further comprises a data logging unit and a manipulator arm for positioning the data logging unit to be in wired connection with the sensor cable or to be within a predetermined distance from the one or more sensors to be wirelessly connected to the one or more sensors, the data logging unit configured to receive and store the measurement data recorded by the one or more sensors. In preferred embodiments, the system further comprises a manipulator arm control unit configured to control operation of the manipulator arm, the manipulator arm control unit configured to receive input from the user interface and/or to automatically perform positioning of the data logging unit.

According to embodiments, the system further comprising a gateway configured to communicate with a plurality of the data loggers for receiving the measurement data and forwarding the measurement data to a client device in substantially real time. Thereby, safe monitoring over time of a potentially dangerous site, such as a site in the vicinity of a structure imminent of failure, can be realized.

According to the above, data from the one or more sensors at a measurement location of the site is sent from the data logging unit towards a gateway which in turn transmits the data to the client/engineer, generally through an IP connection. Thresholds can be set to trigger alarms which provide early warnings that sub-surface conditions have become critical and that risk is imminent.

According to a fourth aspect, a computer program is provided, the computer program comprising codes and/or instructions to, when executed by a processing system, causing a remotely operated machine, preferably a machine according to any one of the aspects or embodiments described herein above, to perform a set of successive steps; said set of successive steps comprising:

- tracking and controlling movement of said mobile platform to a first predetermined location using position data from said tracking unit;
- controlling deployment and adjustment of said support legs; and
- controlling deployment and penetration of said sensor into the subsurface;
- wherein each of the successive steps is configured to transmit a signal indicating that the step has been executed in accordance with specification; and
- wherein the computer program is configured such that a subsequent of the successive steps is only performed upon receipt of said signal or of an instruction based on said signal.

Each of the steps may comprise transmitting the signal to the user interface of the remote workstation, whereby execution of one or more of the successive steps can be initiated by an instruction input from the operator via the user interface. The computer program, or software, may advantageously be configured or programmed to control and/or realize operation of the machine and system as described herein above, such as to realize a remotely operated machine for subsurface measurement and/or sensor installation.

According to preferred embodiments, the computer program, or software, uses learning algorithms and/or artificial intelligence for updating its coding and/or functioning, thereby improving the various functions and steps of operation, or events, performed by the machine.

The different aspects, features and embodiments described herein above can be combined, as will be understood by a person skilled in the art.

BRIEF DESCRIPTION OF THE DRAWINGS

Further features and advantages of the invention will become apparent from the description of the invention by way of non-limiting and non-exclusive embodiments. These embodiments are not to be construed as limiting the scope of protection. The person skilled in the art will realize that other alternatives and equivalent embodiments of the invention can be conceived and reduced to practice without departing from the scope of the present invention. Embodiments of the invention will be described with reference to the figures of the accompanying drawings, in which like or same reference symbols denote like, same or corresponding parts, and in which.

DESCRIPTION OF EMBODIMENTS

Figure 1:
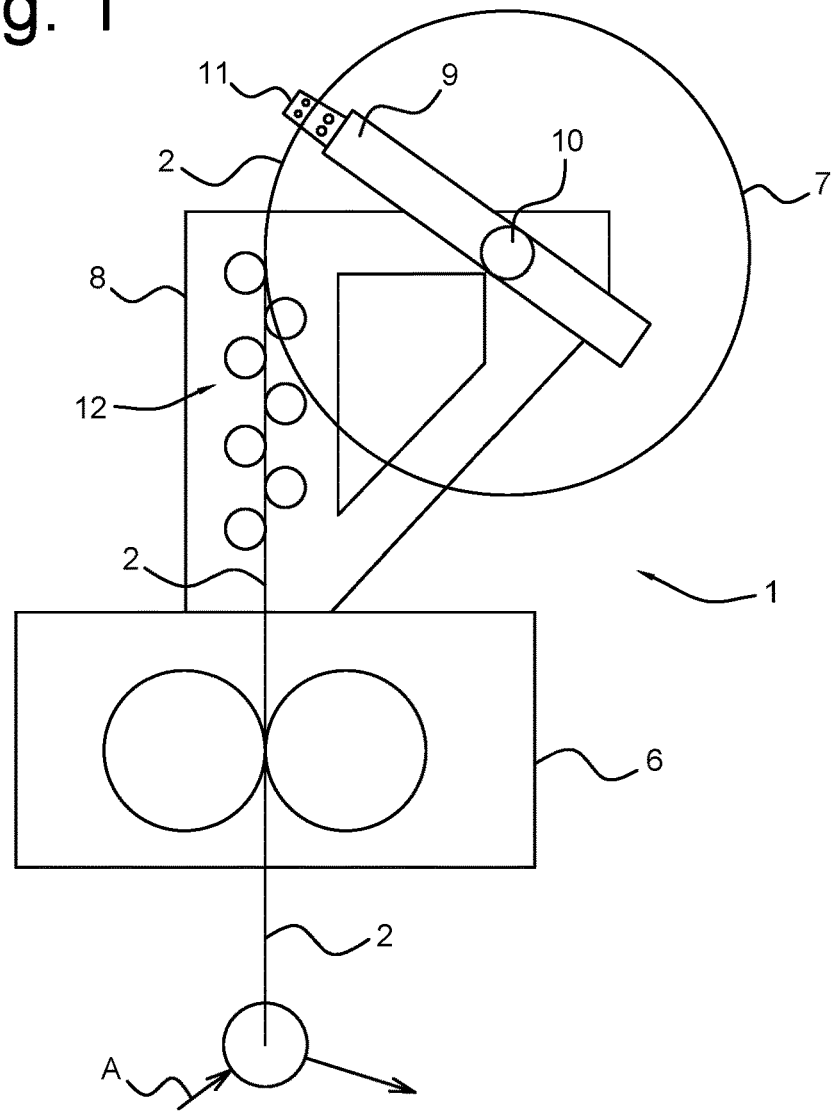
FIG. 1 shows a schematic drawing of a part of a geotechnical apparatus according to an embodiment.

FIG. 1 shows a non-limiting embodiment of a geotechnical apparatus 1, for insertion of a probe or sensor holder 3 into the ground. The apparatus may advantageously be a cone penetrometer testing apparatus or an apparatus for inserting one or more sensors into the ground.

Figure 8:
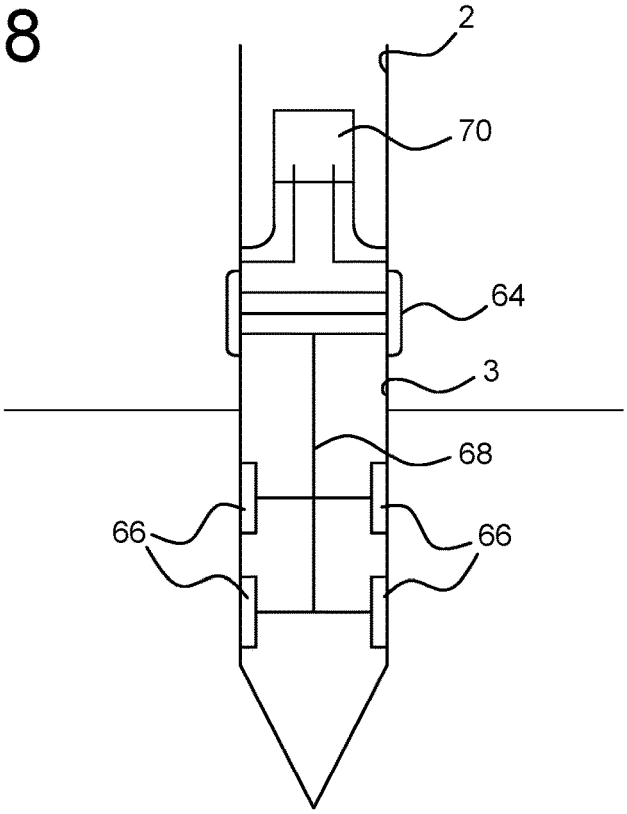
FIG. 8 schematically shows a detail of a probe to be positioned in the subsurface using the remotely operated machine of FIG. 3 and/or system of FIG. 4, according to an embodiment.

The apparatus 1 comprises a rod 2, which is formed in one single piece, provided at its lower extremity A with a probe, or sensor holder, 3. The probe 3 may be a penetrometer as more clearly shown in FIG. 2 or a sensor holder as illustrated in FIG. 8. The probe or sensor holder comprises or is provided with one or more sensors, such as pressure transducers, gas sensors, temperature sensors, etc.

The rod 2 preferably has a longitudinal bore (not shown) extending along its body which is in fluid communication with one or more lubricating openings 4, 5 (indicated in FIG. 2) behind the probe 3 for introducing lubricant along the rod's superficial area while the rod is pushed into the ground or pulled out from the ground. The lubricant reduces friction between the rod 2 and the soil, and contributes to the stability of the borehole and an increased depth of penetration. With the single piece rod 2 of the invention the lubricant can be provided through the one or more lubrication openings 4, 5 at a constant flow rate. The lubrication openings are advantageously provided immediately behind the probe, such that the lubrication fluid effectively fills the annulus in the borehole surrounding the rod behind the probe, without spoiling the soil formation. As lubricant, water or mud may be used, although other fluids may also be used.

The apparatus 1 further comprises a drive unit 6 for the single piece rod 2 for pushing said rod into the ground or pulling it from the ground. The pushing or pulling of the rod may for example be realized by gripping elements (not shown) and/or rollers included in the drive unit 6. Two grippers, having gripping elements gripping the rod, may be provided, for alternatingly gripping the rod and moving it along its longitudinal axis over a predefined length. Thereby, sufficient pulling and pushing force can be realized using a driver with relatively few moving parts. Alternatively, other type of driving or deployment mechanism may be used, providing a substantially constant movement of the rod.

The drive unit preferably comprises hydraulic means for realizing the movements of the components of the drive unit responsible for the movement of the rod into or out of the ground. These movements include the movements of the gripping elements to grip the rod as well as the movements of the grippers in a direction along the longitudinal axis of the rod. The drive unit is arranged to move the rod with a constant movement. This means that stick/slip between the rod and the ground can be avoided and thus the friction is reduced. The continuous push that is achieved also results in a higher quality data acquisition due to the avoidance of the stop start data gaps that occur in the traditional method of CPT.

The apparatus 1 further comprises a storage 7 for the rod 2, in which the rod 2 can be stored in coiled condition and from which the rod 2 is retrievable in the coiled condition. To support this storage and retrieval of the single piece rod 2 preferably a bender/straightener 8 is provided between the storage 7 and the drive unit 6 to convert the single piece rod 2 from the coiled condition to a straight condition and vice versa. By rotation of the storage 7, or a part thereof, the rod 2 can be coiled or uncoiled, respectively, depending on the direction of rotation. The bender/straightener advantageously comprises a plurality of rollers 12. The rollers 12 may be arranged as a first set of rollers positioned at one side of the rod and a second set of rollers positioned at an opposing side of the rod, so as to arrange that the rollers are arranged to convert the coiled rod to an essentially straight rod when uncoiling and are arranged to convert the straight rod to a coiled rod of essentially constant coil diameter when coiling the rod onto the storage 7.

In the embodiment illustrated in FIG. 1, the storage 7 is embodied with a guide arm 9 which is rotatable around an axis 10 of rotation. The guide arm 9 has a clamp 11 distant from the axis 10 of rotation which fixes the single piece rod 2 to the guide arm 9. This arranges that rotation of the guide arm 9 causes the single piece rod 2 to coil or uncoil depending on the direction of rotation of the guide arm 9. Alternatively, the storage 7 may comprise a drum, onto which the rod 2 can be coiled and from which it can be uncoiled in the manner described above.

A protection frame (not shown) may be provided for protecting elements of the apparatus, for example during transport and/or movement/positioning of the apparatus.

Figure 2:
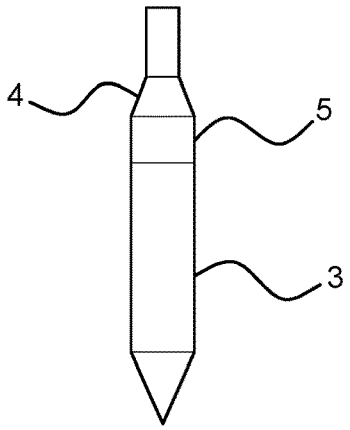
FIG. 2 shows a probe 3 which may be located at section A of the apparatus of FIG. 1.
Figure 3:
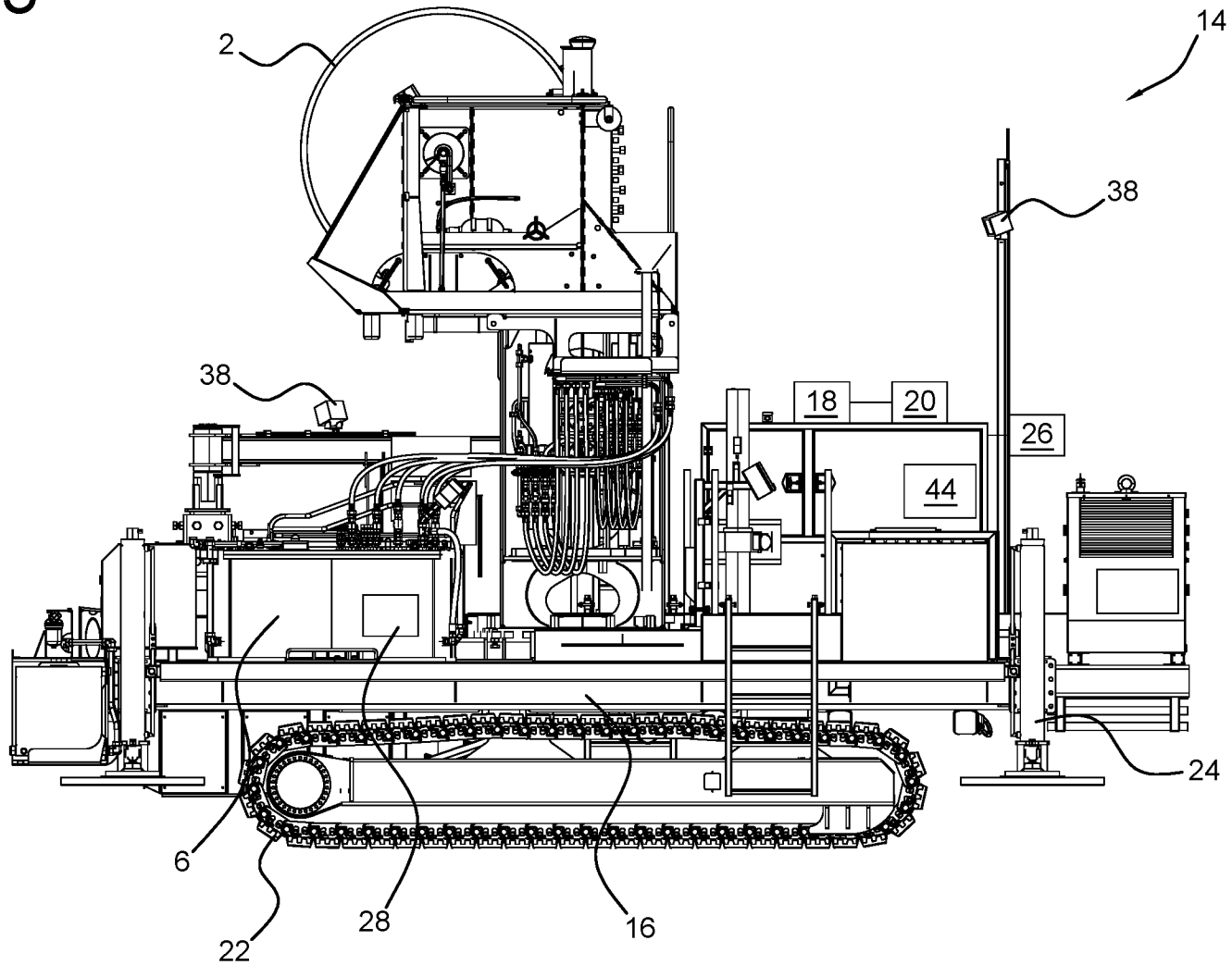
FIG. 3 shows a schematic illustration of a remotely operated machine according to an embodiment.

FIG. 3 shows a remotely operated machine 14, which may advantageously comprise the geotechnical apparatus 1 described herein above with reference to FIGS. 1 and 2. Alternatively, it may comprise another geotechnical apparatus.

The remotely operated machine 14 comprises a mobile platform 16, which carries the rod 2, which in FIG. 3 is shown stored in its coiled state. At one end of the rod 2 the probe 3 (not shown in FIG. 3) is mounted. The probe is configured to be penetrated, e.g. pushed, into the ground as the rod is uncoiled. The probe comprises one or more sensors, generally pressure transducers for monitoring changes in porewater pressure of the subsurface. Alternatively or additionally, other sensors such as gas sensors and/or temperature sensors may be provided. The drive unit 6, which facilitates the coiling and uncoiling of the rod 2 and the penetration of the probe 3 into the subsurface, is controlled by a deployment control unit 28, which may be located on the platform.

The machine 14 further comprises a tracking unit 18, such as a GPS, providing position coordinates data, for tracking the position of the machine. In conjunction with a tracking control unit 20 and a propulsion unit 22, such as crawlers, caterpillar drives, or wheels, it facilitates guidance of the remotely operated machine to the measurement locations where the subsurface measurements should be performed or sensors positioned into the subsurface. In some embodiments, the machine further comprises one or more IP connected cameras 38 which may provide further assistance in the positioning and guidance of the machine, as will be described in more detail further herein below.

Although the propulsion unit 22 in the illustrated example comprises caterpillar drives, also other means are foreseen, such as a wheel drive system. That is, the machine 14 could alternatively be carried by a wheel based truck instead of the caterpillar driven vehicle.

A plurality (generally four) of adjustable support legs 24 are provided, for levelling and stabilizing the mobile platform 16 prior to and during penetration of the probe into the subsurface. The adjustable support legs 24 are controlled by a levelling control unit 26 which controls deployment and adjustment of the support legs.

Figure 4:
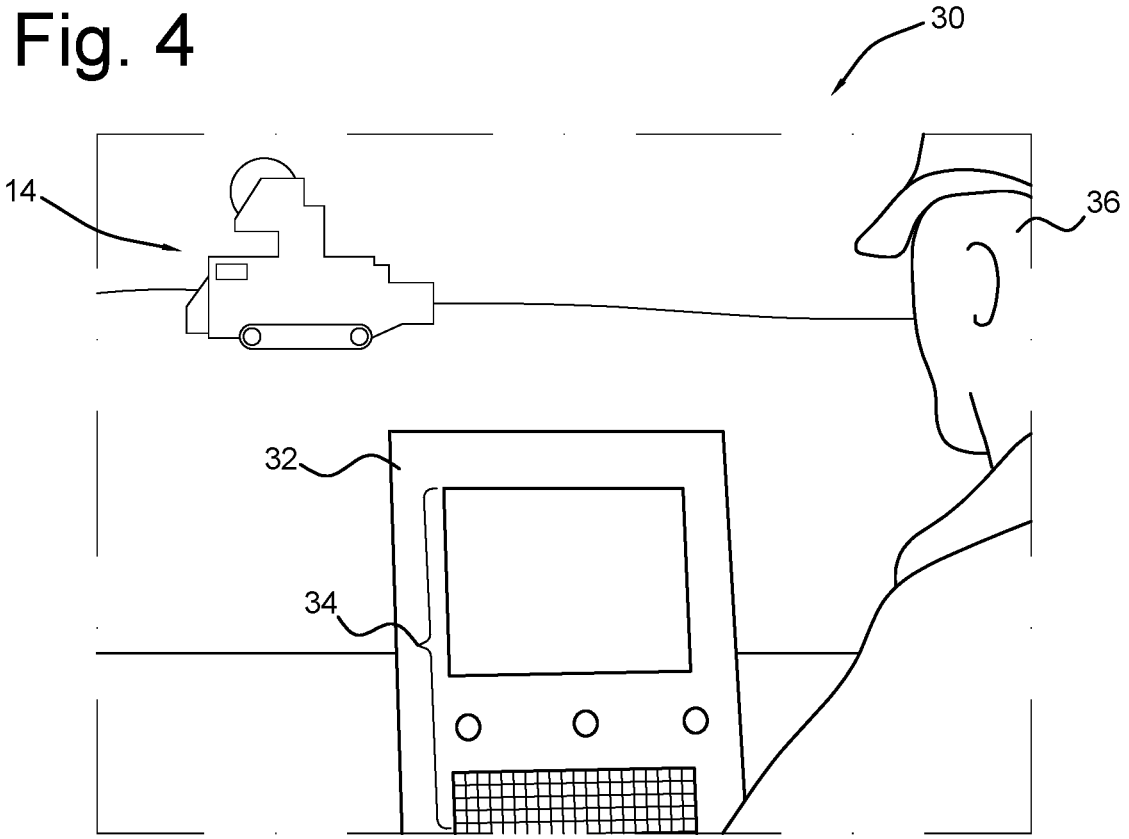
FIG. 4 shows a system comprising the remotely operated machine of FIG. 3.

In the illustrated embodiment the remotely operated machine 14 comprises a communication unit 44, enabling the transmission of data and/or control signals from the various components of the remotely operated machine 14 to a remote workstation 32, illustrated in FIG. 4, and for receiving signals from the remote workstation and/or other external units. The communication unit 44 is connected, via a wired connection or wirelessly, to the tracking control unit 20, the levelling control unit 26, the deployment control unit 28, the camera 38, and to the sensors located on the probe 3. Alternatively, each of these devices may be equipped with its own communication unit for communicating with the remote workstation 32. The different control units and other components may also be configured to communicate with one another. The transmission of data, such as position coordinate data, sensor measurement data, and image data from the cameras, from the machine 14 to the remote workstation 32, as well as control data and steering commands from the remote workstation 32 to the remotely operated machine 14, takes place in substantially real time. Thereby, fully remote operation of the machine can be achieved.

FIG. 4 shows the system 30 comprising the remotely operated machine 14 and the remote workstation 32 from which operation of the machine 14 can be monitored and/or controlled. The remote workstation 32 comprises a user interface 34 for outputting data to an operator 36 and receiving input data from the operator, for example to initiate operation of one or more of the components or devices on the machine or for intervening or providing instructions relating to their operation. The tracking control unit 20, levelling control unit 26, and deployment control unit 28 communicate with the remote workstation 32 such that operation of each of these units can be monitored, initiated, and/or controlled via the user interface 34 of the remote workstation. The data output by the user interface may comprise indications of the functioning and operation of different components of the machine 14, indications of whether or not functions, events or operations have executed successfully or not, measurement data recorded by the sensors of the probe, image data from the one or more cameras 38, etc. Input data may comprise commands for controlling one or more functions of the machine 14, initiating one or more functions, operations or events performed by the components thereof. Thereby, via the remote workstation 32, the operator 36 can monitor and if applicable control operation of the remotely operated machine 14 from a distance, without having to be positioned on the machine 14. The distance may generally be some hundred meters, up to about 500 meters, preferably within line of sight. In some embodiments, the distance may be even longer. Thereby, sites at potentially high risk, such as areas downstream a tailing dam or other structure potentially imminent of failure, can be monitored and surveyed without putting the human operator 36 in danger.

Although only one machine 14 is illustrated in FIG. 4, the remote workstation 32 may be configured for simultaneously controlling more than one remotely operated machines 14.

Figure 5:
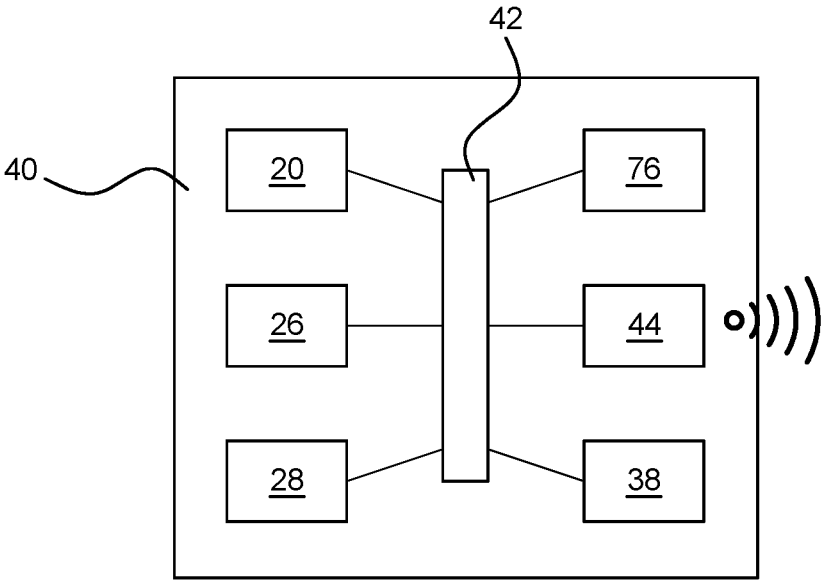
FIG. 5 shows a functional illustration of a processing system 40 of the system of FIG. 4 according to an embodiment.
Figure 9:
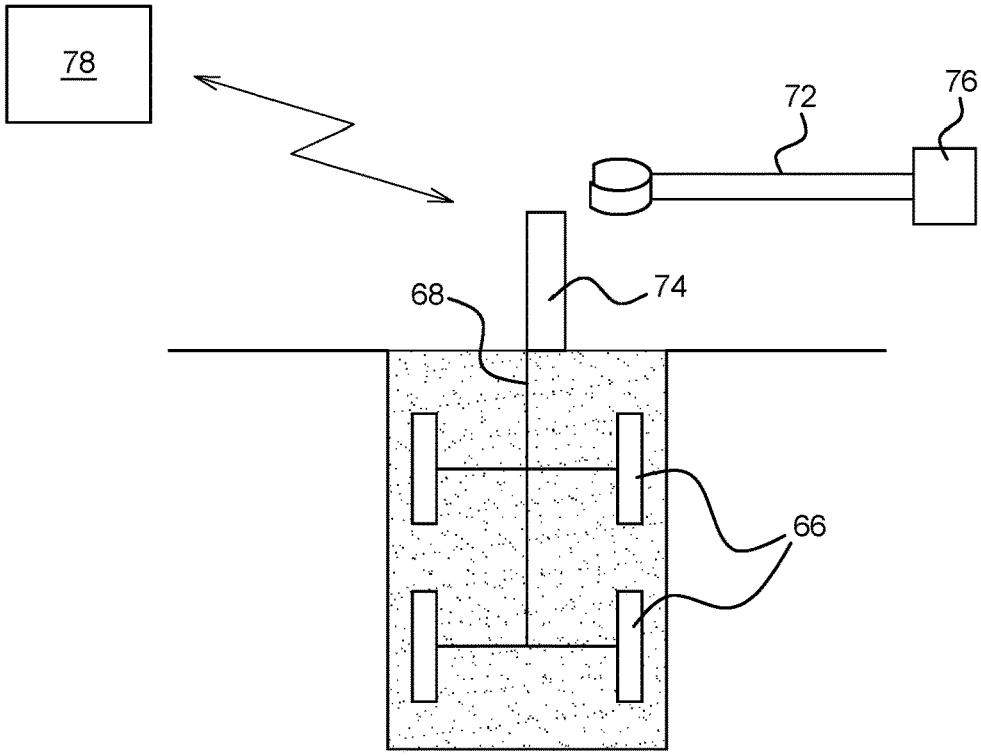
FIG. 9 schematically illustrates further features relating to the remote monitoring of a site.

The tracking control unit 20, levelling control unit 26, and the deployment control unit 28 are preferably realized by programmable logic controls, PLCs, which may be operationally connected and/or form part of a processing unit, or system, 40, as conceptually in FIG. 5. The tracking control unit 20, the levelling control unit 26, and the deployment control unit 28 are configured to communicate with one another, for example via a central unit or connection 42. This central unit or connection may be represented by, or comprise, physical, i.e. wired, connections or wireless communication. Each of the tracking control unit, the levelling control unit, and the deployment control unit is configured to transmit a signal indicating that its associated operation has been executed in accordance with specification. This signal triggers the operation of the control unit responsible for the next step of operation of the remotely operated machine 14, as will be described in more detail further herein below. Additional units or processors may form part of the processing system 40, such as a manipulator arm control unit 76 (described with reference to FIG. 9 further herein below). Different components of the machine 14, such as the sensors of the probe 3 and the cameras 38 may also be operationally connected to or communicating with the processing system. It should be noted that the processing system 40 may not be a physical entity or single unit, but may be abstractly realized by the various units and components being functionally and/or operationally interacting with one another and/or a central processor and/or software program for realizing the operation of the remotely controlled machine 14.

The different control units may be located physically close to one another, or at a distance from one another. Although in FIG. 4, the tracking control unit 20, levelling control unit 26, and deployment control unit 28 are all illustrated as being located on the platform 16, one or more of the processing system 40 may be located remote from the platform 16. Further, components, such as control units and/or data input/output circuits and communication circuit, of the remote workstation 32 may also be considered to form part of the processing system 40.

Operation of the Machine

Figure 6:
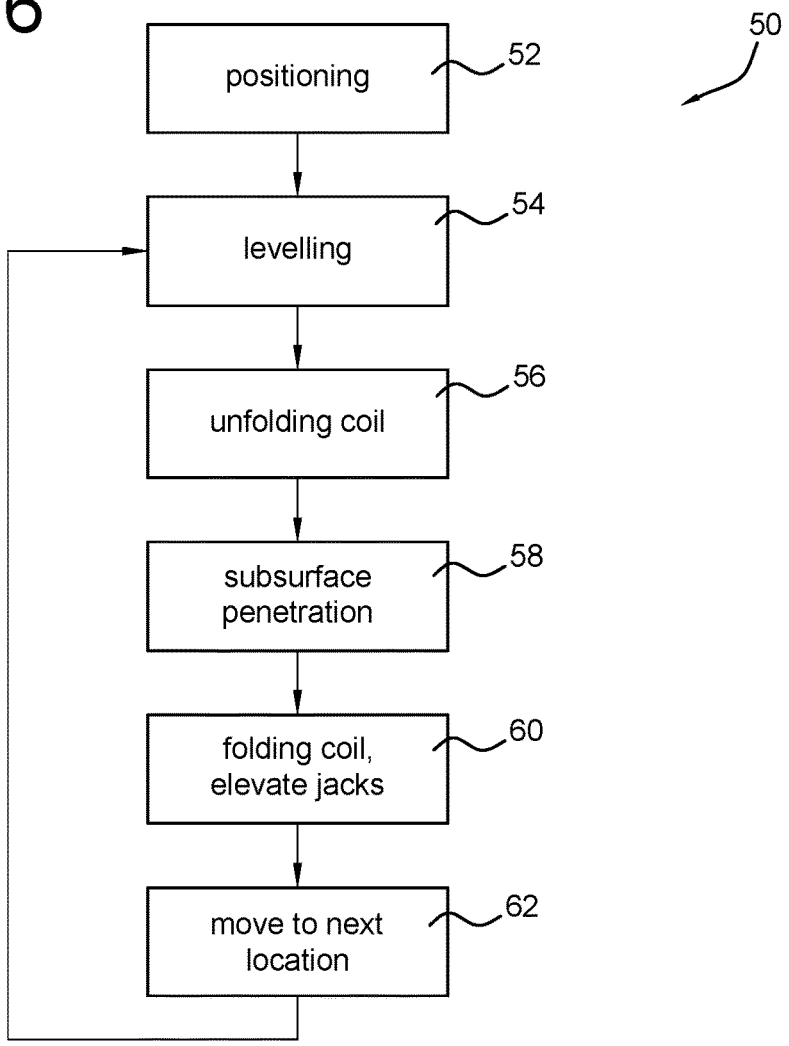
FIG. 6 schematically illustrates a method of operation of the system of FIG. 4 according to an embodiment.

As illustrated in FIG. 6, the operation of the remotely operated machine 14 can be considered a chain of successive steps or events, wherein each event is initiated by, and only performed if, the preceding event having successfully executed. That is, after operation of the machine 14 has been initiated by the operator 36, each of the successive events only takes place if the previous event has been executed or performed in compliance with specification, i.e., has completed successfully, without any unacceptable error or malfunction occurring. Each of the successive events described herein below may be initiated automatically in response to the signal emitted by one of the control units described herein above upon completion of their respective operation, or by the operator 36, via an input to the user interface 34 of the remote workstation 32, manually initiating the next event in response to the signal.

In the first event 52, or step of the operation, the remotely operated machine 14 is moved to a first position L1 under control of the GPS and the tracking control unit 20. At the first position L1, the machine is positioned with high accuracy, generally within 2 cm of the specified position. When the specified position of the machine 14 has been verified, a positive signal, i.e., a signal indicating a successful positioning event, is emitted and the operation continues with the next event 54.

In the second event 54, in response to receiving the signal from the tracking control unit that the machine 14 has been positioned at a predetermined location, the levelling control unit 26 controls deployment and adjustment of the support legs 24 to level the platform 16 and stabilize it.

In the third event 56, which is optional, the coiled rod may be transitioned from a folded position, in which it may be arranged during transport or movement of the machine 14, to an unfolded position, wherein the coil is oriented in the substantially upright position illustrated in FIGS. 1 and 3. In some embodiments, this step may be controlled by the deployment control unit 28, and may form part of the deployment event 58.

In the fourth event 58, the geotechnical apparatus located on the platform 16 is deployed. In response to receiving the signal from the levelling control unit 26 that the mobile platform has been stabilized and levelled, or receiving a signal that the coil formed by the coiled rod has been transitioned to the unfolded position, the deployment control unit 28 controls operation of the drive unit 6 to initiate penetration of the probe 3 into the subsurface. The subsurface penetration may advantageously be controlled based on data recorded by the plurality of sensors of the probe. After the probe 3 has been pushed to a certain depth, and measurements such as CPT measurements have been performed, and/or after the probe 3 has been inserted into the subsurface according to specification and decoupled from the rod 2, the rod 2 is retracted from the subsurface by the driving unit 6, under control of the deployment control unit 28, operating to cause the rod 2 to be coiled up again.

In the fifth event 60, which is also optional, the coil may be moved back into the folded position prior to movement of the machine 14 to the next location. In some embodiments, this step may be controlled by the deployment control unit, and may form part of the deployment event 58.

In the sixth event 62, in response to a signal indicating that the deployment according to event 58, or the folding according to event 60, has been executed successfully, the tracking control unit 20 controls movement and tracking of the machine 14 to a next location and positioning at this location. This location may be a predetermined second location, L2, at which the probe 3 is to be penetrated into the subsurface while performing measurements such as CPT measurements, and/or for being positioned in the subsurface for enabling monitoring over time.

If subsurface penetration has been performed, or attempted, at each of a plurality of predetermined locations L1-Ln, or if the machine 14 or some of its components has been determined to be malfunctioning, the next location of event 62 may be a default position, such as a default end position, of the machine 14. In general, this default end position may correspond to an initial position from which operation of the machine 14 was initiated, for example unloaded from a lorry carrying the machine to and from the monitoring site.

If any of the above described events has not been executed according to specification, i.e., has not executed successfully, the positive signal is not emitted. Preferably, a negative signal is emitted, providing a warning or indication to the operator 36 that the event was not successful. The system may perform another attempt at performing the event in question, or jump to the last event 62, in the chain 50 of events.

Herein below, specific details of the different events and the related control units according to advantageous embodiments are described.

Events 52, 62—Tracking and Positioning

The tracking and positioning of the machine is facilitated with the tracking unit, e.g. a GPS, as described above. The path of movement may be predetermined, based on topographical data and using satellite navigation systems. Alternatively, the path of movement may be adjusted, or even determined, substantially real time, as will be described further herein below. The velocity at which the machine moves is controlled by the tracking control unit, preferably based on input from the operator via the user interface of the remote control.

The image data recorded by the one or more cameras 38 may be transmitted to the tracking control unit 20, which may further comprise an obstacle detection system configured for detecting an obstacle located along and/or adjacent an intended path of movement of the machine 14, or between a present position of the machine and the next predetermined measurement location. The obstacle detection may be performed taking the image data recorded by the cameras 38 into account. The path of movement of the machine 14 to any of the measurement locations L1-Ln or to the default end position may be controlled, for example be automatically recalculated, based on one or more obstacles detected by the obstacle detection system. Alternatively, the image data generated by the cameras and/or indications of obstacles detected by the obstacle detection system may be transmitted to the remote workstation for display on a display of the input/output unit, allowing the operator 36 to input instructions for the processing system to recalculate the path of movement of the machine, or manually redetermining the path of movement.

The tracking control unit 20 may further be configured to determine the path of movement of the machine 14 based on the position thereof detected by the tracking unit 18 and previously recorded or known topographical data of the site to be monitored or surveyed. This may be performed automatically under control of a computer program, such as the computer program described herein below. Alternatively or additionally, the topographical data may be displayed on the remote workstation 32, overlaid or superpositioned on a satellite navigation map. This enables the operator to gain insight into the path of movement and/or the properties and potential obstructions between the different measurement locations. The tracking control unit 20 may be configured to determine the path of movement of the machine 14 based on input from the operator 36.

During the above described tracking of the movement of the machine, the tracking control unit may transmit one or more second signals to the central unit 42 of the processing system 40 and/or to the remote workstation 32. This second signal may comprise further data relating to the operation of the tracking control unit and the tracking of the machine. At the remote workstation 32, it may be processed or directly used to provide information to the operator. The central unit 42 may forward the second signal or data therein, eventually after first having processed it, to the levelling control unit and/or the deployment control unit.

The above described features enables the machine 14 to be positioned at a predetermined position or location with high accuracy. The accuracy may be such that the machine is positioned within 2 cm of the specified position.

Events 54, 60—Levelling of the Platform:

Once the machine has been positioned at one of the measurement locations, operation of the levelling control unit 26 is triggered. Under control of the levelling control unit, the support legs 24 are deployed, by extending each support leg from its holder unit and adjusting the length of each leg such that the machine, or more specifically the platform 16, is levelled in a horizontal plane, and stably supporting it in levelled position. Once stable levelling has been achieved the first signal is transmitted, indicating the event 54 to have been executed in accordance with its specifications.

When the subsurface measurements and/or positioning of one or more sensors have been finished and the rod 2 has been retracted to its coiled state, the operation of the levelling control unit is again triggered. Now the support legs are retracted, such that the machine 14 can be tracked to a next position.

Event 58—Subsurface Penetration:

When the machine 14 has been levelled and stabilized operation of the deployment control unit 28 is triggered. As described above, the deployment control unit controls operation of the hydraulic drive system 6, also referred to as Cone Deployment System, CDS, rotating the coil such as to uncoil the rod 2 and driving it into the subsurface. The uncoiling of the rod 2 is preferably driven such that the probe 3 is penetrated into the ground at a substantially constant rate.

During penetration of the rod 2 and the probe 3 into the subsurface, the deployment control unit 28 may receive measurement data recorded by the one or more sensors located in the probe 3. The probe penetration and the measurements, typically pressure measurements, may form part of Cone Penetration Testing, CPT, measurements, which are known in the field. Alternatively or additionally, other types of measurements, such as gas monitoring, e.g. detection of one or more specified gases, and/or temperature measurements, may be performed. The measured data may be transmitted to the remote workstation 32, where a graphical plot based on the measured data may be displayed in substantially real time. To this end, the measured data may have been processed, by the deployment control unit 28 or the central unit 42 of the processing system 40, and/or by a processor at the remote workstation 32. The graphical plot allows the operator 36 to monitor the subsurface penetration real time, and enables real time intervention by the operator.

Additionally, the measured data may be processed and/or stored for later analysis as well as for learning processes of the processing system and/or a software thereof, using artificial intelligence to improve the operation of the machine. The graphically presented data is automatically processed by software and ready for interpretation and reporting to the client. Live, or real time, reporting can be executed if so desired.

In preferred embodiments, the deployment control unit 28 and/or the central unit 42 of the processing system 40 is further configured to detect and/or predict a subsurface obstruction, or the probability of such subsurface obstruction, located further subsurface than the probe 3, based on the data measured by the sensors. Such subsurface obstruction detection may be further improved by the software or computer program, which controls the operation of the deployment control unit 28, using artificial intelligence. By predicting such subsurface obstruction, probe penetration can be stopped prior potential failure being caused by the obstruction, thereby avoiding damage to the probe, the rod, and/or other components of the machine. Conventionally, the subsurface penetration of the rod was controlled by an operator located at the machine, who based on his knowledge and experience made an estimate of potential subsurface obstructions and terminated penetration based on that. Using computer processing and calculations, advantageously in conjunction with artificial intelligence, has been observed to greatly increase the accuracy of the prediction, enabling the probe penetration to be stopped prior to, even just prior to, the obstruction. Such learning may be performed based on accumulation of measurement data over extended time and a plurality of different sites.

The penetration of the probe into the subsurface may also be controlled taking into account the position coordinates, i.e. the GPS coordinates, of the point of penetration and/or known stratigraphic data. The position coordinates and the stratigraphic data may also be taken into account by the system during subsurface failure prediction.

Figure 7:
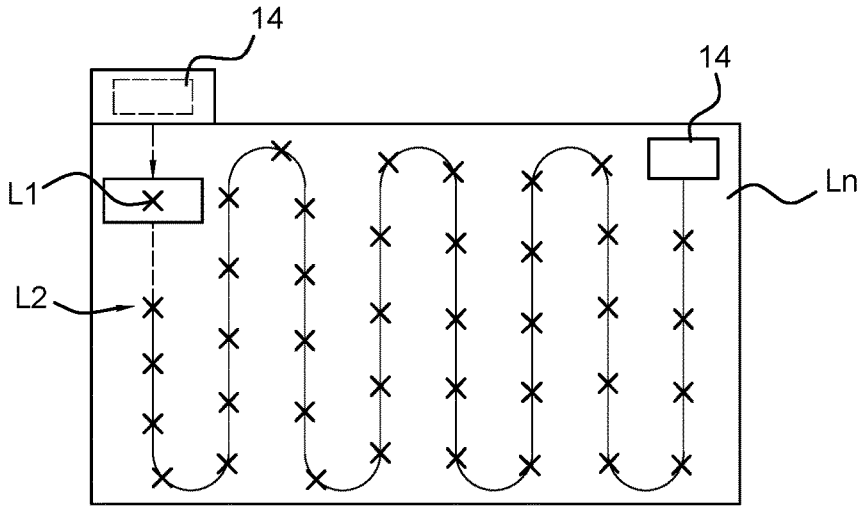
FIG. 7 schematically illustrates a plurality of measurement locations at a site.

The remotely operated machine is advantageously used for performing measurements of the ground conditions, e.g. CPT measurements, and/or for inserting one or more sensors into the subsurface for continuous surveying, at a large plurality of locations L1, L2, . . . , Ln, as illustrated in FIG. 7. At each of these locations, the chain of events described above with reference to FIG. 6 may be performed. The operation may start from an initial position $L_{initial}$, which may be represented by the position from which the machine is launched. After subsurface penetration has been performed at the last location Ln, the machine may be tracked backed to the initial position.

Control of the Events, Computer Program:

The chain of events 50 described above, comprising the events 52-62, is controlled by a computer program, or software, comprising instructions which, when executed by the processing system 40 and/or one of the control units comprised therein, controls the machine 14 to be operated as described above with respect to the plurality of events.

The computer program, or one or more modules or functions thereof, may rely on artificial intelligence, AI, for updating the corresponding program part or function based on learning and/or experience gathered over time during operation of one or more remotely operated machines 14. One example of this is the prediction of subsurface hazards described above. Other examples relate to the tracking and positioning of the machine.

The computer program or software may be modular, wherein each of the events is represented by a separate module or (set of) function(s) of the program. The separate modules or functions may be called upon by a main code of the program, wherein each module or set of functions may be called upon automatically upon the main code receiving a command representing the positive signal, i.e., the signal indicating successful execution of an event, and/or upon receipt of a command generated by an input from the operator 36 via the user interface 34 of the remote workstation. By the modularity of the program, each module or function may be separately reprogrammed and/or updated.

Installation of Sensors for Continuous Monitoring of a Site

In some situations, it may be desirable to perform monitoring of a site and its subsurface properties over time, in particular at a site downstream a structure imminent of failure and/or at a site at potential risk itself. This can advantageously be facilitated by using the remotely operated machine, illustrated in FIG. 3, and the system illustrated in FIGS. 4, for subsurface positioning one or more sensors at a plurality of measurement locations, L1-Ln. This may be performed by operating the machine as described above, in particular by the chain of events illustrated in FIG. 6.

FIG. 8 schematically illustrates features relevant for embodiments in which the remotely operated machine 14 is a machine for installing sensors at subsurface locations. The machine may be the machine 14 illustrated in FIG. 3. Although the machine is preferably based on, and comprises all features of the machine 14 illustrated in FIG. 3, it will be understood by the skilled person that some or more features described above may be dispensed with.

To this end, the probe 3 is mounted to the rod 2 such as to enable disconnection of the probe 3 from the rod 2 after the probe 3 has been penetrated into the subsurface, preferably to a predetermined or specified distance into the ground. This may be achieved by the friction between the probe and its surrounding as the rod is retracted from the subsurface. Alternatively, it may be achieved by a connection mechanism 64 allowing disconnection of the probe 3 to be triggered from remote and/or automatically upon a set subsurface penetration depth having been reached. The probe 3 comprises one or more sensors 66, such as pressure transducers, gas sensors, temperature sensors, etc. The sensors 66 may be positioned in the subsurface with the probe 3 remaining in the ground as a whole. Alternatively, the sensors 66 may be disconnected from the probe 3, under the friction force, or by a disconnection mechanism operationally similar to the connection mechanism 64.

The sensors 66 are connected to a sensor cable 68 allowing the measurement data of the sensors to be stored in a memory or data logging unit, and/or transmitted by a transmitter.

The machine further comprises a pumping unit 70 for filling a void, or annulus, between the one or more sensors 66, or the probe 3, and the surrounding ground. The void is filled with a substantially solid or elastic substance fixating the sensors at their subsurface location.

After the plurality of sensors 66 have been inserted into the subsurface and the rod 2 has been retracted, a data logging unit 74 is positioned above ground at the plurality of sensors using a manipulator arm 72 of the machine 14. The operation of the manipulator arm 72 is controlled by a manipulator arm control unit 76. The manipulator arm control unit preferably forms part of the processing system 40 in a manner similar to the tracking control unit 20, the levelling control unit 26, and the deployment control unit 28, and enables automatic and/or semi-autonomous positioning of the data logging unit 74. Similar to the operation of the other parts and components of the machine 14, the positioning of the data logging unit 74 can be monitored and/or influenced via the remote workstation 32.

The data logging unit may be physically connected to the top of the sensor string, or cable, 68, forming a wired connected with the one or more sensors. Alternatively, the data logging unit may communicate with the one or more sensors via wireless communication.

One or more sensors 66 and an associated data logging unit 74, hence form a monitoring unit. Generally a plurality of monitoring units are positioned at the site to be monitored, e.g. by positioning one monitoring unit at each of the locations, L1, L2, . . . , Ln of FIG. 7.

The data logging unit 74 receives and logs the data measured by the sensors 66. The sensor data is transmitted, either real time, at preset time intervals, or upon request, to a gateway 78. The gateway 78 generally communicates with a plurality of data logging units 74 at the site. Via the gateway 78 the data measured by the sensors can be transmitted, preferably real time or at intervals, to a client device for monitoring and/or analyzing at a remote location.

It will be clear to a person skilled in the art that the scope of the invention is not limited to the examples discussed in the foregoing, but that several amendments and modifications thereof are possible without deviating from the scope of the invention as defined in the attached claims. While the invention has been illustrated and described in detail in the figures and the description, such illustration and description are to be considered illustrative or exemplary only, and not restrictive. The present invention is not limited to the disclosed embodiments but comprises any combination of the disclosed embodiments that can come to an advantage.

Variations to the disclosed embodiments can be understood and effected by a person skilled in the art in practicing the claimed invention, from a study of the figures, the description and the attached claims. In the description and claims, the word "comprising" does not exclude other elements, and the indefinite article "a" or "an" does not exclude a plurality. In fact it is to be construed as meaning "at least one". The mere fact that certain features are recited in mutually different dependent claims does not indicate that a combination of these features cannot be used to advantage. Any reference signs in the claims should not be construed as limiting the scope of the invention. Features of the above described embodiments and aspects can be combined unless their combining results in evident technical conflicts.

The invention claimed is:

1. A system, comprising:

a remotely operated machine comprising a mobile platform, the mobile platform carrying:

a rod, configured to be stored in a coiled state on the mobile platform;

a probe comprising one or more sensors, the probe configured to be mounted to a first end of the rod and to be penetrated into the a subsurface by uncoiling the rod; and a tracking unit configured to determine a position of the mobile platform; and a plurality of adjustable support legs for stabilizing and/or levelling the mobile platform;

a remote workstation configured to be located remote from the remotely operated machine, the remote workstation comprising a user interface for outputting data to an operator and receiving input data from the operator;

a processing system, comprising:

a tracking control unit configured to track and control movement of the mobile platform using position data from the tracking unit;

a levelling control unit configured to control deployment and adjustment of the plurality of adjustable support legs; and a deployment control unit configured to control coiling of the rod, uncoiling of the rod, penetration of the probe into the subsurface, and retraction of the probe from the subsurface, wherein the tracking control unit, the levelling control unit, and the deployment control unit are configured to communicate with the user interface of the remote workstation such that operation of each of these units can be monitored, initiated and/or controlled via the user interface, and wherein each of the tracking control unit, the levelling control unit, and the deployment control unit is configured to transmit a signal indicating that its associated operation has been executed in accordance with specification.

2. The system according to claim 1, wherein the levelling control unit is configured to initiate deployment and adjustment of the plurality of adjustable support legs in response to receiving the signal from the tracking control unit that the mobile platform has been positioned at a predetermined location.

3. The system according to claim 1, wherein the deployment control unit is configured to initiate penetration of the probe into the subsurface in response to receiving the signal from the levelling control unit that the mobile platform has been stabilized and levelled.

4. The system according to claim 1, wherein the user interface is configured to receive a signal from the operator for triggering operation of any one or more of the tracking control unit, the levelling control unit, and the deployment control unit.

5. The system according to claim 1, wherein the deployment control unit is configured to receive measurement data from the one or more sensors and to control penetration of the probe into the subsurface based on the measurement data.

6. The system according to claim 5, wherein the deployment control unit is further configured to detect and/or predict a potential subsurface obstruction located further subsurface than the probe based on the measurement data and to stop the penetration of the probe prior to failure to the system caused by a subsurface obstruction.

7. The system according to claim 5, wherein the deployment control unit is further configured to control the penetration of the probe based on the position of the mobile platform received from the tracking unit and/or stratigraphic data related to the position.

8. The system according to claim 7, wherein the deployment control unit is further configured to detect and/or predict a potential subsurface obstruction located further subsurface than the probe based on the measurement data and the position and/or the stratigraphic data, and to stop the penetration of the probe prior to realizing failure to the system due to the subsurface obstruction.

9. The system according to claim 1, wherein the mobile platform is further provided with one or more cameras, wherein the one or more cameras are configured to communicate with the remote workstation for transmitting image data thereto; and wherein the tracking control unit comprises an obstacle detection system; wherein the user interface is configured to output the image data and data from the obstacle detection system.

10. The system according to claim 1, wherein the tracking control unit is further configured to determine a path of the movement of the mobile platform based on the position of the mobile platform obtained by the tracking system control unit and on prerecorded topographical data.

11. The system according to claim 1, wherein the user interface is configured to display prerecorded topographical data overlaid on a satellite navigation data map, and wherein the tracking control unit is configured to control the movement of the mobile platform along a path of the movement determined based on indications input by the operator.

12. The system according to claim 1, wherein the tracking control unit is configured to control a velocity of the mobile platform based on input from the operator via the user interface of the remote workstation.

13. The system according to claim 1, wherein each of the tracking control unit, the levelling control unit, and the deployment control unit is configured to transmit a second signal comprising one or more pre-defined parameters related to an outcome and/or result of its operation, and wherein the processing system is configured to process the second signal and/or forward the second signal to another one of the tracking control unit, the levelling control unit, and the deployment control unit.

14. The system according to claim 1, wherein the mobile platform comprises a coil support device for supporting the rod in the coiled state and allowing the rod to transition between the coiled state and an uncoiled state, wherein the coil support device can be positioned in a folded mode or in an unfolded mode, and wherein the deployment control unit is configured to make the coil support device transition from the folded mode to the unfolded mode prior to penetration of the probe into subsurface.

15. The system according to claim 1, wherein the deployment control unit is configured to penetrate the probe at a substantially constant rate, and wherein the processing unit system is configured to display a graphical plot on the user interface based on measurement data from the one or more sensors.

16. The system according to claim 1, wherein the remotely operated machine is a machine for installing sensors at subsurface locations, and wherein the probe is configured to be disconnected from the first end of the rod upon or prior to retraction of the rod from the subsurface, and wherein the probe further comprises a sensor cable and the one or more sensors are connected to the sensor cable.

17. The system according to claim 16, further comprising a pumping unit for filling a void between the one or more sensors and surrounding ground with a fixation material.

18. The system according to claim 16, further comprising a data logging unit and a manipulator arm for positioning the data logging unit to be in wired connection with the sensor cable or to be within a predetermined distance from the one or more sensors such as to be wirelessly connected to the one or more sensors, the data logging unit configured to receive and store measurement data.

19. The system according to claim 18, wherein the processing system further comprises a manipulator arm control unit configured to control operation of the manipulator arm, wherein the manipulator arm control unit is configured to receive input from the user interface and/or to automatically perform positioning of the data logging unit.

20. The system according to claim 18, further comprising a gateway configured to communicate with a plurality of data loggers for receiving the measurement data and forwarding the measurement data to a client device in substantially real time.

* * * * *